US005736243A

United States Patent [19]

Aneja

[11] Patent Number: 5,736,243

[45] **Date of Patent: *Apr. 7, 1998**

[54] POLYESTER TOWS

[75] Inventor: Arun Pal Aneja, Greenville, N.C.

[73] Assignee: E. I. du Pont de Nemours and Company, Wilmington, Del.

[ * ] Notice: The term of this patent shall not extend beyond the expiration date of Pat. No. 5,591,523.

[21] Appl. No.: 662,804

[22] Filed: Jun. 12, 1996

Related U.S. Application Data

[63] Continuation-in-part of Ser. No. 497,495, Jun. 30, 1995, Pat. No. 5,591,523, and Ser. No. 642,650, May 3, 1996, which is a continuation-in-part of Ser. No. 497,499, Jun. 30, 1995, abandoned.

[51] Int. Cl.[6] ..... D02G 3/00

[52] U.S. Cl. ..... 428/357; 428/397; 428/400

[58] Field of Search ..... 428/357, 397, 428/400

[56] References Cited

U.S. PATENT DOCUMENTS

| | | | |
|---|---|---|---|
| 3,022,880 | 2/1962 | Newman | 428/397 |
| 3,156,607 | 11/1964 | Strachan | 161/177 |
| 3,335,211 | 8/1967 | Mead et al. . | |
| 3,914,488 | 10/1975 | Gorrafa | 429/397 |
| 4,092,299 | 5/1978 | MacLean et al. | 264/210 |
| 4,113,704 | 9/1978 | MacLean et al. | 528/289 |
| 4,316,924 | 2/1982 | Minemura et al. | 428/397 |
| 4,634,625 | 1/1987 | Franklin | 428/397 |
| 4,707,407 | 11/1987 | Clark et al. | 428/397 |
| 4,812,361 | 3/1989 | Takemoto et al. | 428/397 |
| 4,833,032 | 5/1989 | Reese | 428/364 |
| 4,916,013 | 4/1990 | Maeda et al. | 428/397 |
| 4,954,398 | 9/1990 | Bagrodia | 428/397 |
| 4,996,107 | 2/1991 | Raynolds et al. | 428/397 |
| 5,108,838 | 4/1992 | Tung | 428/397 |
| 5,188,892 | 2/1993 | Grindstaff | 428/397 |
| 5,208,106 | 5/1993 | Tung | 428/397 |
| 5,234,645 | 8/1993 | Grindstaff | 269/103 |
| 5,308,564 | 5/1994 | Grindstaff | 264/103 |
| 5,387,469 | 2/1995 | Warren | 428/397 |
| 5,591,523 | 1/1997 | Aneja | 428/397 |

FOREIGN PATENT DOCUMENTS

WO 92/13120 8/1992 WIPO .

OTHER PUBLICATIONS

Dictionary of Fiber & Textile Technology p. 9 date 1965.

*Primary Examiner*—Newton Edwards

[57] ABSTRACT

Tow that is suitable for processing on a worsted or wollen system and that consists essentially of continuous polyester filaments that have a scalloped-oval cross-section with grooves or channels that run along the length of the filaments. Such polyester tows provide improved processing on the worsted system to provide spun yarns of polyester and blends with wool, and downstream articles, such as fabrics and garments.

1 Claim, 3 Drawing Sheets

POLYESTER TOWS

CROSS-REFERENCE TO RELATED APPLICATION

This is a continuation-in-part of my application Ser. No. 08/497,495 (DP-6255) filed Jun. 30, 1995, now U.S. Pat. No. 5,591,523, and Ser. No. 08/642,650 (DP-6365-A) now allowed, filed May 3, 1996 as a continuation-in-part of application Ser. No. 08/497,499 (DP-6365), also filed Jun. 30,1995, now abandoned.

FIELD OF INVENTION

This invention relates to new polyester tows that are suitable for conversion to a worsted or woollen system sliver and downstream processing on such systems, and to processes relating thereto and products therefrom.

BACKGROUND OF THE INVENTION

Polyester fibers are either (1) continuous filaments or (2) fibers that are discontinuous, which latter are often referred to as staple fibers or cut fibers. Both terms "fiber" and "filament" are often used herein inclusively. Use of one term does not exclude the other, unless a qualified term, such as "continuous filament", or "staple fiber" or "cut fiber" is used. Polyester staple fibers are made by first being formed by extrusion into continuous polyester filaments, which are processed in the form of a tow of continuous polyester filaments before being converted into staple.

This invention provides new tows of continuous polyester filaments that provide advantages in being capable of better processing downstream on the worsted or wollen system.

Mostly, the objective of synthetic fiber producers has been to replicate advantageous properties of natural fibers, the most common of which have been cotton and wool fibers.

Most of the polyester cut fiber has been of round cross-section and has been blended with cotton. A typical spun textile yarn is of cotton count 25, and of cross section containing about 140 fibers of 1.5 dpf (denier per filament) and 1.5 inch length. It has been the custom to match dpf and length. Denier is the weight in grams of 9000 meters of fiber and thus a measure in effect of the thickness of the fiber. When one refers to denier, the nominal or average denier is often intended, since there is inevitably variation along-end and end-to-end, i.e., along a filament length and between different filaments, respectively. In general, it has been the objective of fiber producers to achieve as much uniformity as possible in all processing steps along-end and end-to-end so as to produce a polyester fiber of round cross section and of a single denier and of as uniform denier as practical. 1.5 dpf and 1.5 inch length corresponds to 1.7 dtex and almost 4 cm.

Polyester/worsted yarns are different from polyester/cotton yarns, typically being of worsted count 23, and of cross section containing about 60 fibers for single yarn and about 42 fibers for bi-ply yarn, with fibers that have been of 4 dpf and 3.5 inch length (4.4 dtex and almost 9 cm). The yarn count may vary over 55 worsted to 10 worsted, while the denier and length may vary up to about 4.5 (5 dtex and 11.5 cm) and down to about 3 (3.3 dtex and 7.5 cm). It is only relatively recently that the advantages of using synthetic fibers of dpf lower than the corresponding natural fibers (such as wool) have been found practical and/or been recognized. Recent attempts to provide low dpf polyester fiber for blending with wool on the worsted system have not, however, been successful, and require improvement. As the fiber denier has been reduced, the fibers have become harder to process (carding, drafting, gilling, etc.) in the mill. In fact, below a certain fiber denier, the polyester fibers that I have tried have been practically impossible to process, and/or have given poor quality fabrics. Thus, for commercially acceptable processing and blending with wool in practice, I have found that the fiber denier of such polyester fibers has had to be a minimum of about 3 dpf (3.3 dtex). Tows of (nominal) dpf less than 3 are not believed available commercially at this time. This has been the status so far in the trade. Thus far, trying to manipulate a desire to reduce dpf has appeared to be contradictory or incompatible with satisfactory mill processibility.

Processing on the worsted system is entirely different from most practice currently carried out on the cotton system, which generally uses cotton fiber that is sold in bales and that may be mixed with polyester fiber that is primarily staple or cut fiber, that is also sold in compacted bales. In contrast, for processing on their system, worsted operators want to buy a tow of polyester fiber (instead of a compacted bale of cut fiber) so they can convert the tow (which is continuous) into a continuous sliver (a continuous end of discontinuous fibers, referred to hereinafter shortly as "cut fiber") by crush cutting or stretch breaking. This sliver is then processed (as a continuous end) through several stages, i.e., drafting, dyeing, back-washing, gilling, pin-drafting and, generally, finally blending with wool. It is very important, when processing on the worsted system, to maintain the continuity of the sliver. Also, however, it is important to be able to treat the cut fiber in the sliver appropriately while maintaining a reasonably satisfactory processing speed for the continuous sliver. As indicated, recent attempts to reduce dpf for polyester tow for worsted processing have not produced desired results. For instance, unsatisfactorily low machine productivity rates have been required after dyeing; I believe this may have been because such polyester fiber has previously packed together too tightly.

As indicated, commercially-available polyester staple fiber has, hitherto, generally been of round cross-section. The price of polyester fiber is generally an important consideration, and a round cross-section is the easiest cross-section to make and the most economic. Other cross-sections have been suggested for various applications, but I am not aware that any other cross-section (other than round) has actually been processed commercially and used in polyester/worsted apparel or commercially-available except for specialty applications that can command a higher price.

SUMMARY OF THE INVENTION

According to one aspect of the invention, there is provided a tow that is suitable for processing on a worsted or woollen system and that consists essentially of continuous polyester filaments of average denier per filament (dpf) about 0.7 to about 4.5 (0.8 to 5 dtex), wherein said filaments have a cross section that is of scalloped-oval shape with grooves, and said grooves run along the length of the filaments.

I believe that polyester tow whose filamentary cross section is scalloped-oval shaped with grooves that run along the length of the filaments has not previously been sold for processing on the wollen or worsted system. Such polyester tow is usually sold in large tow boxes. It is in the downstream products and their processing that the advantages of the invention are mainly demonstrated, as will be illustrated hereinafter. Such advantages are particularly significant for lower dpf products, preferably in the range of 0.7 to 2.5 dpf (0.8 to about 3 dtex), and especially in the range 0.8 to 1.5 dpf (0.9 to about 2 dtex), but improvements are also available for normal dpfs. Furthermore, the invention is not restricted to any polymer type or modification and is easy and relatively inexpensive to produce commercially.

There are also provided, therefore, such downstream products, according to the invention, especially continuous worsted system polyester (cut) fiber slivers, and yarns, fabrics, and garments from such slivers, including from blends of polyester fiber and of wool fiber and/or, if desired, other fibers, and processes for their preparation and/or use.

According to a preferred aspect of the invention, there is provided a process for preparing a tow of drawn, crimped polyester filaments for conversion into polyester worsted yarns, wherein such process comprises the steps of forming filaments from polyester polymer prepared with a chain-branching agent, and of scalloped-oval shape with grooves that run along the length of the filaments, by spinning through capillaries, by using radially-directed quench air from a profiled quench system, of collecting such filaments in bundles, and combining them into a tow, and of subjecting the filaments to drawing and crimping operations in the form of such tow.

DETAILED DESCRIPTION OF THE INVENTION

As indicated, this invention is concerned with polyester filament tows that are suitable for processing on the worsted or wollen systems. For convenience, most of the detailed description hereinafter will apply to the worsted system, but, as will be understood by those skilled in these arts, the invention is applicable to the wollen system also. Presently, such tows as are available commercially are believed to have been bundles of crimped, drawn continuous filaments of round filament cross section and of denier generally about 900,000 (1 million dtex), each filament being of about 3 denier (3.3 dtex) or more. Use of such filaments of round cross-section was the previous general commercial practice in producing tows for processing on the worsted system.

The present invention is, however, directed primarily at providing polyester tow (crimped, drawn polyester continuous filaments in a large bundle, and including the resulting sliver of cut fibers) for processing on the worsted system (the requirements for which are known in the art) with filaments of a different cross-section, as indicated.

Figure 1:
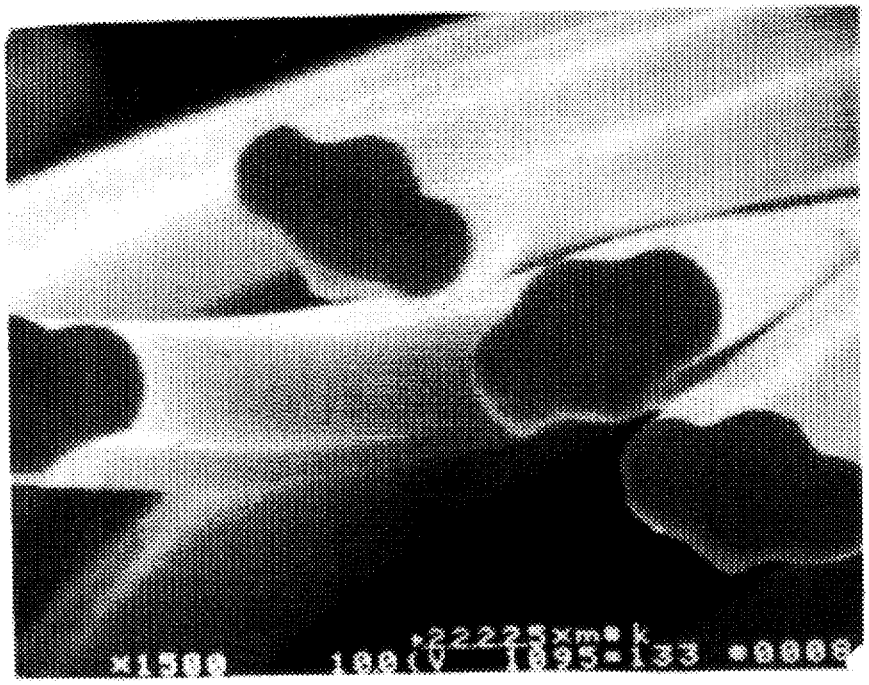
FIG. 1 is a magnified photograph of filaments cut to show a scalloped-oval filament cross section with grooves that run along the length of the filaments, such as may be used in tows according to the invention, including downstream products.

The cross sections of the polyester filaments used according to my invention should not be round but scalloped-oval in shape with grooves that run along the length of the filaments. Typical of such a cross section is a 4-groove-scalloped-oval cross section such as was disclosed, generally, by Gorrafa in U.S. Pat. No. 3,914,488, the disclosure of which is hereby expressly incorporated herein by reference, and a magnified (1500×) photograph of such filaments is shown in FIG. 1 of the accompanying Drawings. Tows of such filaments are described and illustrated in the Examples hereinafter. The term "oval" is used herein generically to include elongated shapes that are not round, but have an aspect ratio (ratio of length to width of cross section) that is more then 1, preferably more than about 1/0.7 (corresponding to a major axis length A: minor axis length B as disclosed by Gorrafa of 1.4); and preferably less than about 1/0.35 (corresponding to Gorrafa's preference of up to about 2.4), at least so far as concerns scalloped-oval. The expression "W/L" is used herein, e.g. in the Tables in the Examples, to indicate the average width/length ratio of the cross-sections of the filaments, being the inverse of aspect ratio. Provision of grooves (indentations or channels) is also important. This is disclosed in the art, and in my copending patent applications Ser. Nos. 08/497,495 (DP-6255) and 08/642,650 (DP-6365-A) referred to hereinabove, the disclosures of which are also hereby expressly included herein by reference, but which express some different preferences therein.

The crimping and drawing and most other product and processing conditions and characteristics have been described in the art, e.g., that referred to.

The polyester polymer used to make the filaments should desirably be essentially 2G-T homopolymer (other than having chain-brancher content, if desired), i.e., poly (ethylene terephthalate), and should preferably be of low relative viscosity; polymers of LRV about 8 to about 12 have been found to give very good results as indicated hereinafter in the Examples. Use of radially directed quench air from a profiled quench system as disclosed by Anderson, et al., in U.S. Pat. No. 5,219,582 is preferred, especially when spinning such low-viscosity polymer. If desired, as indicated, the polymer may be chain-branched, e.g., as indicated in the Examples. This technology has long been disclosed in various art, including Mead and Reese U.S. Pat. No. 3,335,211, MacLean, et al. U.S. Pat. Nos. 4,092,299 and 4,113,704, Reese U.S. Pat. No. 4,833,032, EP 294,912, and the art disclosed therein, by way of example. The amount of chain-brancher will depend on the desired result, but generally 0.3 to 0.7 mole % of polymer will be preferred. Tetraethylsilicate (TES) is preferred as chain-brancher according to the present invention. As disclosed by Mead and Reese, an advantage of using TES is that it hydrolyzes later to provide a desirable low pilling product. Furthermore, polyester copolymers may be used, as shown in Example X, for example.

Aesthetic considerations are very important in apparel and other textile applications. Worsted apparel applications include, for example, men's and women's tailored suits, separates, slacks, blazers, military and career uniforms, outerwear and knits.

Figure 2:
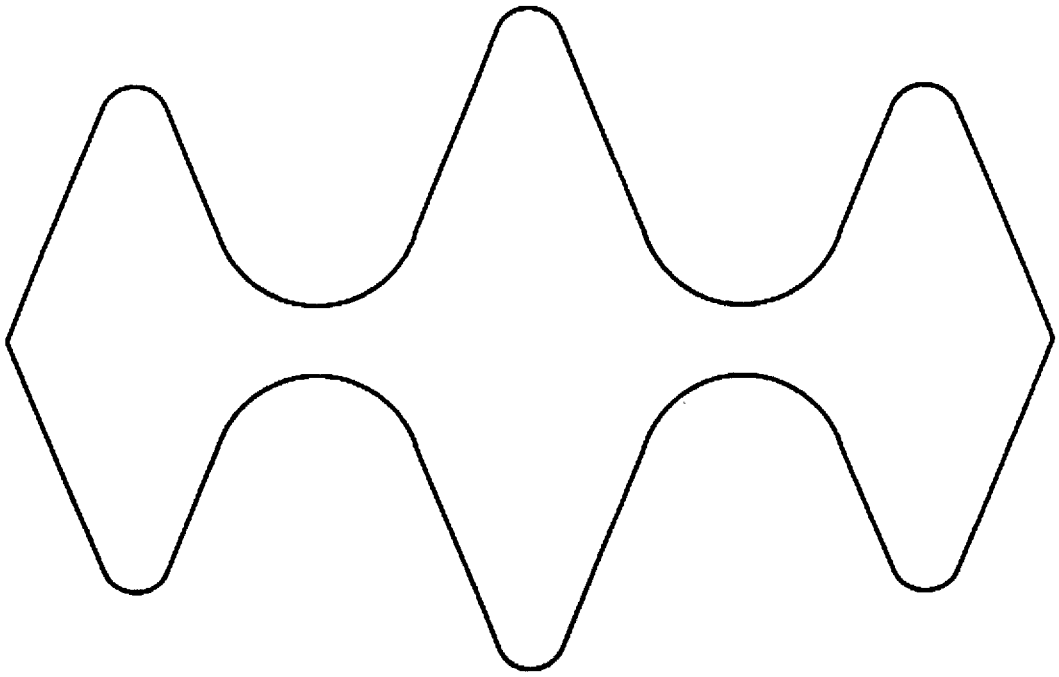
FIG. 2 is a schematic illustration of a capillary orifice for spinning such polyester filaments.

As indicated hereinafter and in the Background hereinbefore, tows of the invention (including their resulting slivers) may be processed with advantages on the worsted system. A suitable capillary orifice shape is shown in FIG. 2, and the process preparation steps are also described hereinafter in the Examples; these generally follow normal procedures, except insofar as described herein.

EXAMPLES

The invention is further illustrated in the following Examples, which, for convenience, refer to processing on the worsted system, which is generally more important, but the tows of the invention could also be processed on a woollen system. Most test procedures are well known and/or described in the art. For avoidance of doubt, the following explanation of procedures that I used are given in the following paragraphs.

MEASUREMENTS AND UNITS

Measurements were made using conventional U.S. textile units, including denier, which is a metric unit. To meet prescriptive practices elsewhere, dtex and CPcm equivalents of the DPF and CPI measurements are given in parentheses after the actual measurements. For the tensile measurements, however, the actual measurements in gpd have been converted into g/dtex and these latter have been given.

Crimp frequency is measured as the number of crimps per inch (CPI) after the crimping of the tow. The crimp is exhibited by numerous peaks and valleys in the fiber. Ten filaments are removed from the tow bundle at random and positioned (one at a time) in a relaxed state in clamps of a fiber-length enough together to prevent stretching of the fiber while placing it in the clamp. One end of a fiber is placed in the left clamp and the other end in the right clamp of the measuring device. The left clamp is rotated to remove any twist in the fiber. The right clamp support is moved slowly and gently to the right (extending the fiber) until all the slack has been removed from the fiber but without removing any crimp. Using a lighted magnifier, the number of peaks on top and bottom side of the fiber are counted. The right clamp support is then moved slowly and gently to the right until all the crimp has just disappeared. Care is taken not to stretch the fiber. This length of the fiber is recorded. The crimp frequency for each filament is calculated as:

$$\frac{\text{Total Number of Peaks}}{2 \times \text{Length of Filament (uncrimped)}}$$

The average of the 10 measurements of all 10 fibers is recorded for the CPI (crimps per inch).

CTU (crimp take up) is measured on a tow and is a measure of the length of the tow extended, so as to remove the crimp, divided by the unextended length (i.e., as crimped), expressed as a percentage, as described in Anderson et al, U.S. Pat. No. 5,219,582.

Figure 3:
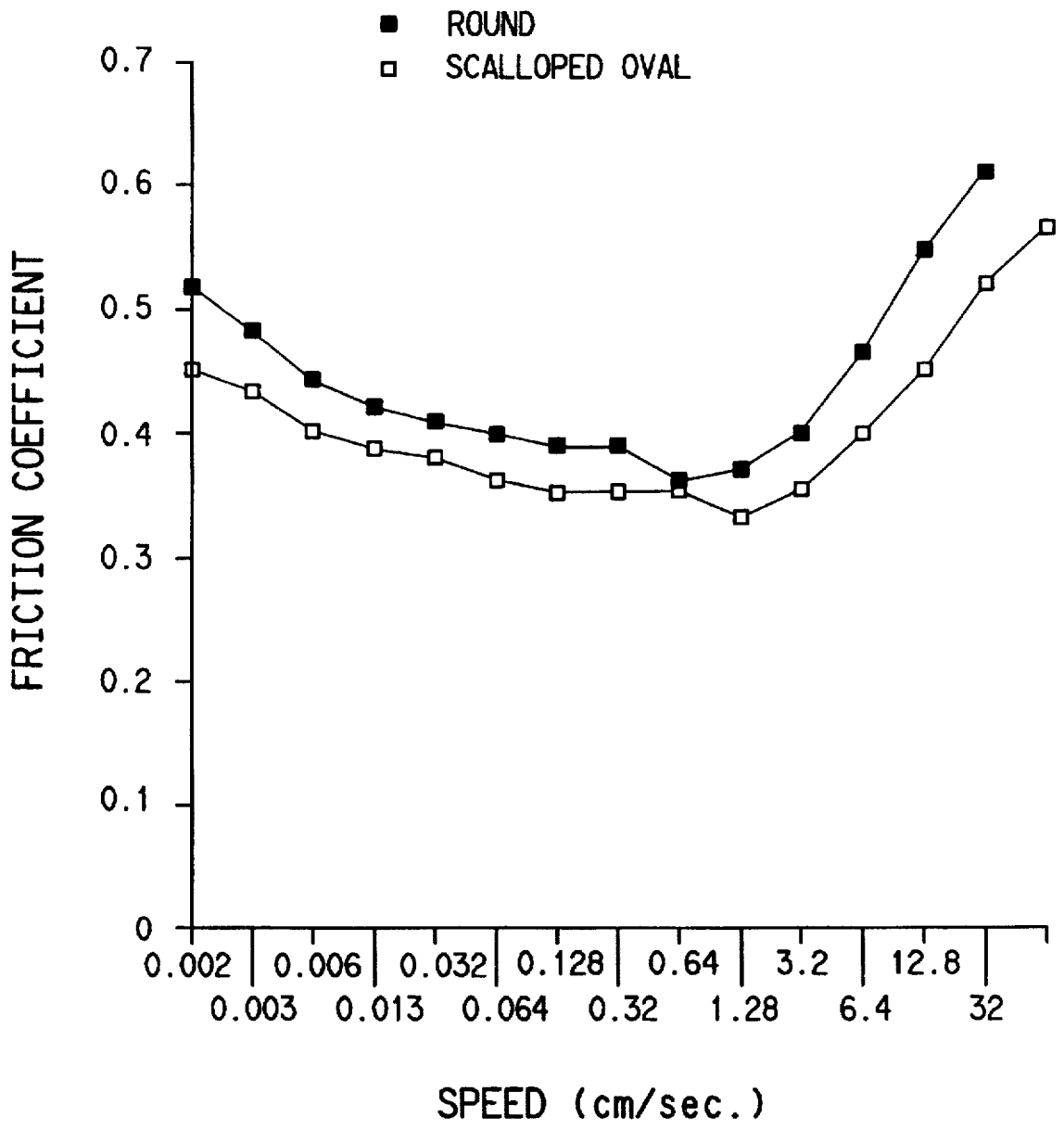
FIG. 3 plots coefficients of fiber-to-fiber friction versus speed for scalloped-oval cross-section filaments and for round cross-section filaments, as explained in Example I.

The fiber-to-fiber friction coefficients shown in FIG. 3 were obtained using the following procedure. A test batt weighing 0.75 gram is made by placing fibers on a one-inch (2.5 cm) wide by 8-inch (20 cm) long adhesive tape. For fiber-to-fiber friction measurements, 1.5 grams of fibers are attached to a 2-inch (5 cm) diameter tube that is placed on a rotating tube on the mandrel. One end of the test batt is attached to a strain gauge and draped over the fibercovered mandrel. A 30-gram weight is attached to the opposite end and tensions are measured as the mandrel rotates at various speeds over a range of 0.0016–100 cm/sec. The coefficients of friction are calculated from the tensions that are measured. Other methods of comparing effects of friction are described following Example II hereinafter.

Relative viscosity was determined as described by Broaddus et al in U.S. Pat. No. 4,712,988, but using a solution of 80 mg of polymer in 10 ml of hexafluoroisopropanol solvent at 25° C.

Example I

Filaments of scalloped-oval cross section (FIG. 1) and of 7.6 dpf (8.4 dtex) were melt-spun at 282° C. from poly (ethylene terephthalate) polymer containing 0.40 weight percent tetraethyl silicate (as described in Mead, et al, U.S. Pat. No. 3,335,211) and having a relative viscosity of 10.1. The polymer was extruded at a rate of 73.8 lbs./hr. (33.5 Kg/hr) from a spinneret containing 450 capillaries. The orifice shape of the spinneret capillaries was as shown in FIG. 2 and of orifice area 0.2428 $cm^2$. The filaments were spun at a withdrawal speed of 1600 ypm (1460 meters/min.) and quenched using radially directed air from a profiled quench system, as described by Anderson, et al., U.S. Pat. No. 5,219,582. The spun filaments were wound as a bundle on a bobbin to give a total filament bundle denier of 3420 (3800 dtex).

Thirty-seven bobbin bundles were combined to form a tow of denier 126,540 (140,000 dtex) for simultaneous draw. The tow was drawn at a draw ratio of 3.0× in 95° C. spray draw of water. The tow was then passed through a stuffer box crimper and subsequently relaxed at 145° C. to give a final tow size of approximately 50,000 denier (55,000 dtex) with a nominal (average) dpf of about 3.0 (3.3 dtex), whose filament properties are listed in Table 1 (SI equivalents being given in parentheses after the U.S. units that were measured for DPF and CPI as mentioned above, whereas the tensile measurements in gpd have been converted to g/dtex throughout these Examples).

TABLE 1

| | DPF | Mod | Ten | $E_B$ % | CPI | W/L |
|---|---|---|---|---|---|---|
| Spun Yarn | 7.8 (8.4) | 18 | 0.7 | 287 | — | 0.68 |
| Drawn Yarn | 3.0 (3.3) | 47 | 2.3 | 17 | 8 (3.2) | 0.65 |

A conventional finish was applied to provide a finish level on the fiber of 0.15% by weight. The tow was collected in a conventional tow box and sent to a mill for downstream processing, blending with wool and yarn conversion.

Successful mill processing of tow (including cutting to form a continuous sliver, dyeing, pin drafting, gilling, etc.) is critical for commercial viability. Poor pin drafting results in process efficiency loss and/or unacceptable product quality. I was surprised that processing the tow and resulting sliver from the present Example (fibers of scalloped-oval cross section) was significantly superior to processing of tow that was similar except that it contained fibers of the same denier but of round cross section. In other words, I was surprised that slivers that were essentially the same in every respect except that the one according to the invention (because the fibers were scalloped-oval-shaped, with grooves or channels that run along the length of the filament) was much superior in processing characteristics than an otherwise similar sliver of fibers of round geometry, and that the former provided eventually fabrics and garments of superior tactility.

The coefficients of fiber-to-fiber friction of the two types were measured and are compared in FIG. 3. It will be noted that round fibers generally have a higher coefficient of friction than fibers of scalloped-oval cross-section. I believe that round fibers have possibly been harder to process due to these higher levels of fiber-to-fiber friction during various pin drafting operations.

Example II

In Table 2, data are similarly summarized for fibers spun essentially as described in Example I and wherein the polymer throughput (throughput measured in lbs./hr., but given in kg/hr.) in the capillary is varied thereby changing the fiber denier. Bobbins were combined to form a tow and then drawn at 2.6× draw ratio, but otherwise as in Example I. The final tow size was approximately 50,000 denier. These tows and their slivers demonstrated good downstream processing characteristics.

TABLE 2

| | | Spun Properties | | | | | Drawn Properties | | | | |
|---|---|---|---|---|---|---|---|---|---|---|---|
| Item | Thruput | DPF | Mod | Ten | $E_B$ % | W/L | DPF | Mod | Ten | Ee% | CPI |
| A | 22.2 | 5.0 (5.6) | 18 | 0.75 | 251 | 0.65 | 2.2 (2.4) | 46 | 2.4 | 16 | 8.5 (3.4) |
| B | 25.2 | 5.7 (6.3) | 18 | 0.70 | 254 | 0.65 | 2.5 (28) | 43 | 2.1 | 30 | 6.4 (2.6) |
| C | 27.1 | 6.2 (6.9) | 17 | 0.70 | 274 | 0.63 | 2.7 (3.0) | 39 | 2.2 | 29 | 15.8 (6.3) |
| D | 32.1 | 7.3 (8.1) | 15 | 0.79 | 293 | 0.68 | 3.0 (3.3) | 47 | 2.3 | 31 | 8.5 (3.4) |
| E | 34.1 | 7.8 (8.7) | 18 | 0.75 | 287 | 0.68 | 3.3 (3.7) | 45 | 2.0 | 26 | 7.7 (3.1) |
| F | 38.2 | 8.7 (9.7) | 18 | 0.80 | 327 | 0.67 | 3.7 (4.1) | 41 | 2.0 | 48 | 6.5 (2.6) |
| G | 42.2 | 9.6 (10.7) | 17 | 0.77 | 319 | 0.66 | 4.1 (4.6) | 41 | 2.0 | 47 | 8.3 (3.3) |

COMPARATIVE MEASUREMENTS VS. ROUND

As has been indicated, how a tow (and the resulting sliver) processes in a mill is critical for commercial viability. To estimate product performance in the mill, staple pad friction and sliver cohesion, both a measure of fiber-to-fiber friction, were measured on drawn fibers from Item D and results were compared with measurements similarly carried out on commercial fibers of same dpf and of matching CPI, but of round cross-section.

The procedures used in the present instance are performed as follows:

Staple pad friction is measured by the force required to pull a movable sled from under a known weight. The force is measured by Instron model 1122. The known weight is of length 2 inch (5 cm), width 1.5 inch (4 cm) and height 1.5 inch (4 cm), weighs 496±1.0 g and is connected to the top clamp of the Instron with 15 inches (38 cm) of nylon cords, while a movable sled, a metallic table of 9×6 inches (23×15 cm) is connected to the bottom clamp, so the sled can only move vertically. The nylon cord at rest is not under tension. The metallic table is covered with 3M-240 grit, 3 Mite, RBC, PSA paper. The weight is covered with Behr-Manning metallic cloth #220JM529 or equivalent on the side facing the table. A fiber pad sample (as described in the following paragraph) is placed between the movable sled and the weight. When the Instron is activated, there is little relative motion between the staple pad and the sled or weight; essentially all motion results from fibers sliding over each other. This gives a measure of fiber-to-fiber friction properties. Four determinations are made on each of two sliver pad samples. The reported value is an average of the eight measurements recorded on the two sliver pad samples.

A sample of the tow is first carded in a Saco-Lowell roller top type card and a pad of dimension 4 inch (10 cm)×2.5 inch (6.3 cm) and weight 1.5±0.15 g is prepared. Pad thickness may be increased by stacking layers of sliver until proper weight is obtained. The sample is placed on the front end of the movable sled and the 496 gm weight is placed on top of the sample. The distance between the sled and the top clamp is set at 8 inch (20 cm) and calibrated to 0.5 Kg for full-scale loading. The cross head velocity is set at 12.5 inches (32 cm)/min. The cross head travels 1.5 inches (4 cm) before stopping the test when the cross head stops. The 496 gm weight is removed from the sample pad and the pad is rotated 180° keeping the same face up. The weight is then replaced on the pad and the test is repeated. When the cross head stops, the pad is turned upside down and test is repeated. When the cross head stops, the pad is rotated 180° and test is repeated. After the fourth observation, a second sliver pad of the same fiber is tested. The staple pad friction, SPF is defined as:

$$SPF\,(\%) = \frac{\text{Stress}}{\text{weight (496 g)}} \times 100$$

The average of eight readings is recorded as the measure of staple pad (fiber-to-fiber) friction. The results of the staple pad friction test are given in Table CA for 3 dpf (3.3 dtex) round fibers and for Item D from Example II, as well as the CPI values, which were matched.

TABLE CA

| Fiber Type | % SPF | CPI |
|---|---|---|
| Round | 57.8 | 8.2 (3.2) |
| Scalloped-Oval | 32.4 | 8.5 (3.4) |

A comparison of these staple pad friction values shows that the fiber from the tow of the invention had much lower fiber-to-fiber friction, only about 60% of that of conventional round fiber [of the same 3 dpf (3.3 dtex) and matching CPI].

Sliver cohesion tests were performed both before and after dyeing. Sliver cohesion tests consist of carding to make a sliver 12 inches (30 cm) long, hanging the sliver vertically and adding weights at the bottom until a load-bearing limit is reached (i.e., until the fibers in the sliver pull apart and the weight(s) drop). For dyed items, the slivers were tightly compacted into nylon bags and pressuredyed at 250° F. (121° C.) for 30 minutes with disperse blue G/F dye, and then dried in forced air oven at 270° F. (132° C.) for 30 minutes before the sliver cohesion was measured. Such tests reflect the magnitude of the frictional property change between items before and after dyeing. Again, for comparison, tests were performed on slivers of the same 3 dpf(3.3 dtex) round fiber (of same polymer and of matching CPI) currently sold commercially. The results of the sliver cohesion tests are given in Table CB.

TABLE CB

| Type | Sliver Cohesion Before Dyeing mg/denier | Sliver Cohesion After Dyeing mg/denier |
|---|---|---|
| Round | 3.54 (3.19) | 5.91 (5.32) |
| Scalloped-oval | 2.03 (1.83) | 4.12 (3.71) |

The silver of the invention (scalloped-oval cross section) had much lower sliver cohesion values than the conventional round fiber-type sliver (of the same dpf) both before and after dyeing.

Example III

Table 3 summarizes data for fibers spun, combined into tows, and drawn, essentially as described in Example IID, and in Table 2, but wherein the capillary size was varied, as was the number of holes (# in Table 3) in a spinneret and hence the optimum dpf that could be obtained for a given polymer throughput rate. The tows and their slivers demonstrated good downstream processing characteristics.

TABLE 3

| | Capillary Data | | | Spun Properties | | | | | Drawn Properties | | | | |
|---|---|---|---|---|---|---|---|---|---|---|---|---|---|
| Item | Area $cm^2$ | # | Thru-put | DPF | Mod | Ten | $E_B$ % | W/L | DPF | Mod | Ten | $E_B$ % | CPI |
| A | 0.2428 | 243 | 27.1 | 11.4 (12.7) | 17 | 0.80 | 315 | 0.66 | 4.9 (5.4) | 33 | 2.1 | 39 | 10 (3.9) |
| B | 0.2428 | 450 | 32.1 | 7.3 (8.1) | 15 | 0.79 | 293 | 0.63 | 3.1 (3.4) | 47 | 2.2 | 31 | 8.5 (3.4) |
| C | 0.2134 | 1054 | 33.1 | 3.3 (3.7) | 18 | 0.77 | 221 | 0.66 | 1.2 (1.4) | 50 | 2.3 | 30 | 8.6 (3.4) |

Example IV

Table 4 summarizes data similarly for drawn fibers spun essentially as described in Example IIIB, but drawn to different draw ratios. The resultant tows were processed without showing any dye defects.

TABLE 4

| Draw Ratio | DPF | Mod | Ten | $E_B$ % | Toughness | CPI |
|---|---|---|---|---|---|---|
| 2.6X | 3.1 (3.4) | 47 | 2.2 | 31 | 0.59 | 8.5 (3.4) |
| 2.7X | 3.0 (3.3) | 42 | 2.3 | 26 | 0.45 | 9.7 (3.8) |
| 2.9X | 2.8 (3.2) | 46 | 2.4 | 22 | 0.38 | 9.2 (3.6) |
| 3.0X | 2.7 (3.0) | 43 | 2.6 | 26 | 0.50 | 8.3 (3.3) |
| 3.1X | 2.6 (2.9) | 39 | 2.5 | 18 | 0.29 | 8.5 (3.4) |
| 3.3X | 2.5 (2.8) | 45 | 3.1 | 20 | 0.37 | 8.4 (3.3) |

Example V

Tows of filaments were made, drawn and processed similarly to the description in Example I, except that these filaments were spun at withdrawal speeds of 800, 1600, and 2000 ypm (corresponding to 730, 1460 and 1830 meters/min.) and that the polymer was extruded at rates of 37, 54.2, and 67.8 lbs./hr. (corresponding to 17, 24.6 and 30.8 Kg/hr.).

Example VI

A. Filaments of poly(ethylene terephthalate) of 9.2 dpf (10.2 dtex) were melt-spun as described in Example 1 except that the polymer was extruded at a rate of 90 lbs./hr. (41 Kg/hr.) per position on a 44-position (450 filaments per position) commercial machine, and all the filaments were collected to form a tow in a can. The total denier of this tow was approximately 182, 160 (202,400 dtex) and the total number of filaments was 19,800. The as-spun filament properties are indicated in Table 6, Item A.

Twelve can of spun supply were combined together to give a tow amounting to 237,600 filaments and of total denier approximately 2.2 million. The tow was drawn at a draw ratio of 3.0× in 95° C. spray-draw of water. The tow was then passed through a stuffer box crimper and subsequently relaxed at 130° C. to give a final tow denier of approximately 780,000 of 3.2 dpf (3.6 dtex) fibers, and a conventional finish was applied to provide a finish level on the fiber of 0.15% by weight. The tow was collected in a conventional tow box and sent to a mill for downstream processing, blending with wool, and yarn conversion. The drawn fiber properties are also shown in Table 6, Item A.

B. The filaments for Item B were prepared and processed similarly except that the polymer was extruded (at the same throughput/position) through 711 capillaries per position, i.e., 711 filaments per position. "#" in Table 6 indicates the number of capillaries (filaments) per position.

TABLE 6

| | | Spun Properties | | | | | Drawn Properties | | | | | |
|---|---|---|---|---|---|---|---|---|---|---|---|---|
| Item | # | DPF | Mod | Ten | $E_B$ % | W/L | DPF | Mod | Ten | $E_B$ % | CPI | W/L |
| A | 450 | 9.2 (10.2) | 18 | 1.0 | 336 | 0.64 | 3.2 (3.6) | 37 | 2.6 | 19 | 9.0 (3.6) | 0.61 |
| B | 711 | 6.0 (6.7) | 17 | 0.9 | 333 | 0.67 | 2.3 (2.6) | 40 | 2.3 | 37 | 8.8 (3.5) | 0.58 |

I was surprised that processing such tows and resulting slivers (from fiber of scalloped-oval cross section) was significantly superior to processing of tows that were similar, except that they contained fibers of round cross section; I believe that the latter have possibly been hard to process due to the effect of unacceptably high levels of friction during various pin-drafting operations.

Example VII

Filaments of similar scalloped-oval cross section were spun of 7.5 and 3.1 dpf (8.3 and 3.4 dtex), but otherwise essentially similarly to the procedure described in Example VI at rates of 73.8 and 70 lbs./hr. (33.5 and 32 Kg/hr.) per position from a 48-position spin machine through 450 and 1054 capillaries, respectively, per position. The total denier of the spun tows collected in cans were, respectively, approximately 162,000 and 379,440. As-spun properties are indicated in Table 7, Items A and B, respectively.

For item A, 14 cans of spun supply were combined together to provide a tow with a total denier of approximately 2.3 million (2.6 million dtex) that was processed (drawn, crimped, and relaxed) essentially as described in Example VI to give a final tow size of approximately 863,000 denier (959,000 dtex). The drawn properties are also listed in Table 7 for Item A and for Item B, which was similarly processed.

TABLE 7

| | | Spun Properties | | | | | Drawn Properties | | | | | |
|---|---|---|---|---|---|---|---|---|---|---|---|---|
| Item | # | DPF | Mod | Ten | $E_B$ % | W/L | DPF | Mod | Ten | $E_B$ % | CPI | W/L |
| A | 450 | 7.5 (8.3) | 16 | 1.0 | 347 | 0.64 | 2.9 (3.2) | 41 | 2.7 | 44 | 6.8 (2.7) | 0.64 |
| B | 1054 | 3.1 (3.4) | 17 | 1.0 | 315 | 0.61 | 1.2 (1.3) | 43 | 3.0 | 30 | 9.4 (3.7) | 0.66 |

Each tow was collected in a conventional tow box and sent to a mill for downstream processing, blending with wool, and yarn conversion, which performed satisfactorily.

In Item B, the tow was of very low dpf filaments, but processed successfully in the mill. This was very surprising because a tow consisting of 2 dpf (2.2 dtex) round fiber geometry did not process acceptably but caused productivity, efficiency, and quality problems, despite its higher denier.

Tow made essentially as described in Item A of this Example VII was treated with durable silicone elastomer finish prior to blending with wool, using an aqueous emulsion at 0.25% concentration of amino methyl polysiloxane copolymer in a water bath at room temperature at a rate of 8 lbs./hr. (3.6 Kg/hr.), and then dried in an oven at 300° F. (149° C.) for 5 minutes to cure the silicone. The resultant silicone level on the fiber was 0.3% by weight. Application of this silicone improved the softness and resiliency of the resulting fabrics, because it reduced the fiber-to-fiber and yarn-to-yarn friction, so gave better aesthetics somewhat similar to previous experience with applying silicone slickener to fiberfill for use in filled articles. In this regard, reference is made also to my copending application Ser. No. 08/662,896 (DP-6460) also filed Jun. 12, 1996, and to be abandoned in favor of application Ser. No. 08/860,527 (DP-6460-A).

Example VIII

A tow of filaments of poly (ethylene terephthalate) of 3.3 dpf (3.7 dtex) was prepared by melt spinning (from polymer containing 0.58 weight % tetraethyl silicate and having a relative viscosity of 8.9) essentially as described in Item B of Example VII. The spun tow collected in a can had a total denier of approximately 166,953 (185,500). Fifteen cans of spun supply were combined together for a total tow denier of approximately 2.5 million (2.8 million dtex) that was processed (drawn, crimped, and relaxed) essentially as described in Example VI to give a final tow size of approximately 900,000 denier (1 million dtex). Properties are listed in Table 8 for both as-spun filaments and drawn filaments.

TABLE 8

| Spun Properties | | | | | Drawn Properties | | | | | | | |
|---|---|---|---|---|---|---|---|---|---|---|---|---|
| DPF | Mod | Ten | $E_B$ % | W/L | DPF | Mod | Ten | $E_B$ % | CPI | CTU | Defects | W/L |
| 3.3 (3.7) | 20 | 0.6 | 264 | 0.71 | 1.2 (1.3) | 46 | 2.2 | 14 | 11.4 (4.5) | 28 | 0 | 0.65 |

The tow was collected in a conventional tow box and sent to a mill for downstream processing, including stretch breaking, followed by blending with wool, yarn conversion, and fabric making, which performed satisfactorily, despite the very low dpf.

Example IX

In Table 9, data are summarized for fibers spun essentially as described in Example I, except as indicated, from polymer as described in Example VIII. The spun tows were drawn and processed as described in Example II to give drawn tows that demonstrated good downstream processing characteristics.

TABLE 9

| | | | Spun Properties | | | | | Drawn Properties | | | | |
|---|---|---|---|---|---|---|---|---|---|---|---|---|
| Item | Thru-put | # | DPF | Mod | Ten | $E_B$ % | W/L | DPF | Mod | Ten | $E_B$ % | CPI |
| A | 26 | 1054 | 2.6 (2.9) | 21 | 0.88 | 278 | 0.65 | 1.05 (1.2) | 57 | 2.6 | 13 | 8.5 (3.3) |
| B | 21 | 1054 | 2.1 (2.3) | 22 | 0.85 | 188 | 0.67 | 0.83 (0.9) | 68 | 2.7 | 11 | 11 (4.3) |
| C | 31 | 450 | 7.2 (8) | 19 | 0.72 | 302 | 0.65 | 2.91 (3.2) | 46 | 2.2 | 15 | 7 (2.8) |

Example X

A. Filaments of poly (ethylene terephthalate) of 3.6 dpf (3.3 dtex) were melt-spun at 293° C. from polymer containing 2.1% (by weight) carbon black powder and having a relative viscosity of 19.3. The polymer was extruded through a spinneret containing 900 capillaries at a rate of 69.5 lbs./hr. (31.5 Kg/hr.) per position from a 45-position commercial machine. All these filaments were spun at a withdrawal speed of 1600 ypm (1460 meters/min) essentially as described in Example 1, except as described, and the spun tow was collected in a can. The total denier of the tow was approximately 145,624 (161,840 dtex) and the total number of filaments was 40,500.

Fifteen cans of spun supply were combined together to give a tow amounting to 607,500 filaments and of total denier approximately 2.2 million (2.4 million dtex). The tow was drawn at a draw ratio of 2.98× in 89° C. spray draw of water. The tow was then processed through a stuffer box crimper and subsequently relaxed at 130° C. to give a final tow denier of approximately 910,000 (1,011,000 dtex) of 1.5 dpf fibers (1.7 dtex). A conventional finish was applied to provide a finish level on the fiber of 0.10% by weight. The tow was collected in a conventional tow box and sent to a mill for downstream processing, blending with wool and yarn conversion. The drawn yarn properties are shown in Table 10, as Item A.

B. Filaments of poly (ethylene terephthalate) of 5.7 dpf were melt-spun at 283° C. from polymer containing 1.98 mole % of sodium dimethyl 5-sulfoisophthalate and having a relative viscosity of 12.7. The polymer was extruded at a rate of 80 lbs./hr. (36 Kg/hr.) per position from a 45-position commercial machine through a spinneret containing 741 capillaries at a withdrawal speed of 1414 ypm essentially as described in Example 1, except as indicated, and the spun tow was collected in a can. The total denier of the tow was approximately 189,674 (210,750 dtex) and the total number of filaments was 33,345.

Twelve cans of spun supply were combined together to give a tow amounting to 400,140 filaments and of total denier approximately 23 million (26 million dtex). The tow was drawn at a draw ratio of 3.17× in 86° C. spray draw of water. The tow was then processed through a stuffer box crimper and subsequently relaxed at 135° C. to give a final tow denier of approximately 900,000 (1 million dtex) of 2.25 dpf (2.5 dtex) fibers. A conventional finish was applied to provide a finish level on the fiber of 0.11% by weight. The tow was collected in a conventional tow box and sent to a mill for downstream processing, blending with wool and yarn conversion. The drawn yarn properties are shown in Table 10, as Item B.

TABLE 10

| Item # | Modification | DPF | Ten | $E_B$ % | CPI | CTU % |
|---|---|---|---|---|---|---|
| A | 2.1 wt % Carbon Black | 1.5 (1.7) | 3.4 | 33 | 8.4 (3.3) | 28 |
| B | 1.98 mole % Dimethyl 5-(sodium sulfoisophthalate) | 2.25 (2.5) | 2.8 | 27.5 | 7.8 (3.1) | 30 |

As will be evident from the Examples (and from the comparisons vs. polyester fibers of conventional round cross-section, which have been the only polyester fibers that have been used previously for worsted processing commercially to the best of my knowledge and belief, a scalloped-oval cross-section has shown advantages over round cross-section, which I have found very surprising. The ability to use and process fibers of lower dpf is particularly advantageous, as described hereinabove. In comparison with tows of mixed dpf fibers, as disclosed in my parent application DP-6255, Ser. No. 08/497,495, filed Jun. 30, 1995, referred to above, the tows of the present application are easier to manufacture and cheaper to make. The possibility of using variants (see Example X) could be advantageous also.

I claim:

1. A tow that is suitable for processing on a worsted or woollen system and that consists essentially of continuous polyester filaments of average denier per filament about 0.7 to about 4.5, wherein said filaments have a cross-section that is of scalloped-oval shape with grooves, and said grooves run along the length of the filaments, and wherein said polyester filaments are of polyester polymer that is of relative viscosity (LRV) about 8 to about 12 and that has a chain-brancher content of 0.3 to 0.7 mole %.

* * * * *